United States Patent [19]

Dillon

[11] Patent Number: 4,620,472

[45] Date of Patent: Nov. 4, 1986

[54] SHELL RELOADING MACHINE WITH SAFETY FEATURES

[76] Inventor: Stephen M. Dillon, 7442 E. Butherus Dr., Scottsdale, Ariz. 85260

[21] Appl. No.: 732,682

[22] Filed: May 10, 1985

[51] Int. Cl.[4] ..... F42B 33/02; F42B 33/10

[52] U.S. Cl. ..... 86/27; 86/25; 86/29; 86/36; 86/37; 86/38

[58] Field of Search ..... 86/23–46

[56] References Cited

U.S. PATENT DOCUMENTS

| | | | |
|---|---|---|---|
| 2,031,850 | 2/1936 | Peterson | 86/27 |
| 3,320,848 | 5/1967 | Ponsness | 86/38 |
| 3,771,411 | 11/1973 | Hazel | 86/27 |
| 4,163,410 | 8/1979 | Dillon | 86/23 |
| 4,328,735 | 5/1982 | Allen | 86/27 |
| 4,343,222 | 8/1982 | Dillon | 86/27 |
| 4,409,878 | 10/1983 | McClenning | 86/36 |
| 4,429,610 | 2/1984 | Mantel | 86/36 |
| 4,522,102 | 6/1985 | Pickens | 86/27 |
| 4,526,084 | 7/1985 | David et al. | 86/27 |
| 4,542,677 | 9/1985 | Lee | 86/36 |

*Primary Examiner*—John F. Terapane
*Assistant Examiner*—Howard J. Locker
*Attorney, Agent, or Firm*—Warren F. B. Lindsley

[57] ABSTRACT

An improved shell reloading machine incorporating in addition to the essential features of utility convenience and low cost, an effective means for the prevention of primer cap detonation which might otherwise occur due to improper alignment of the primer feed mechanism.

9 Claims, 11 Drawing Figures

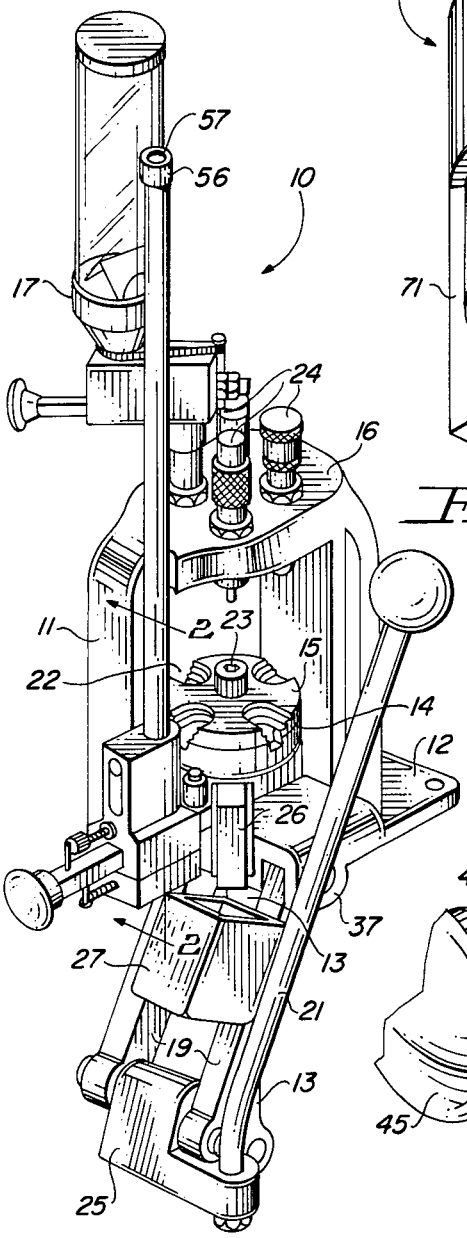
FIG. 1
FIG. 4
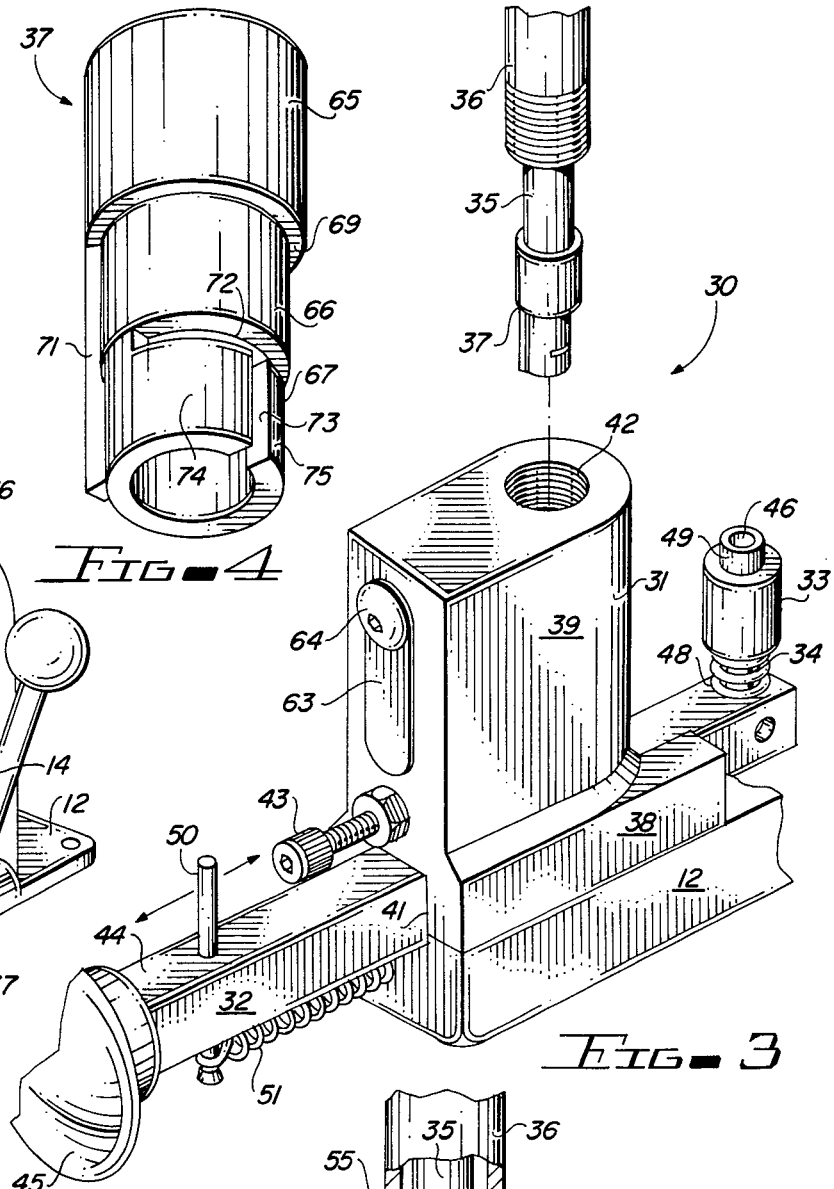
FIG. 3
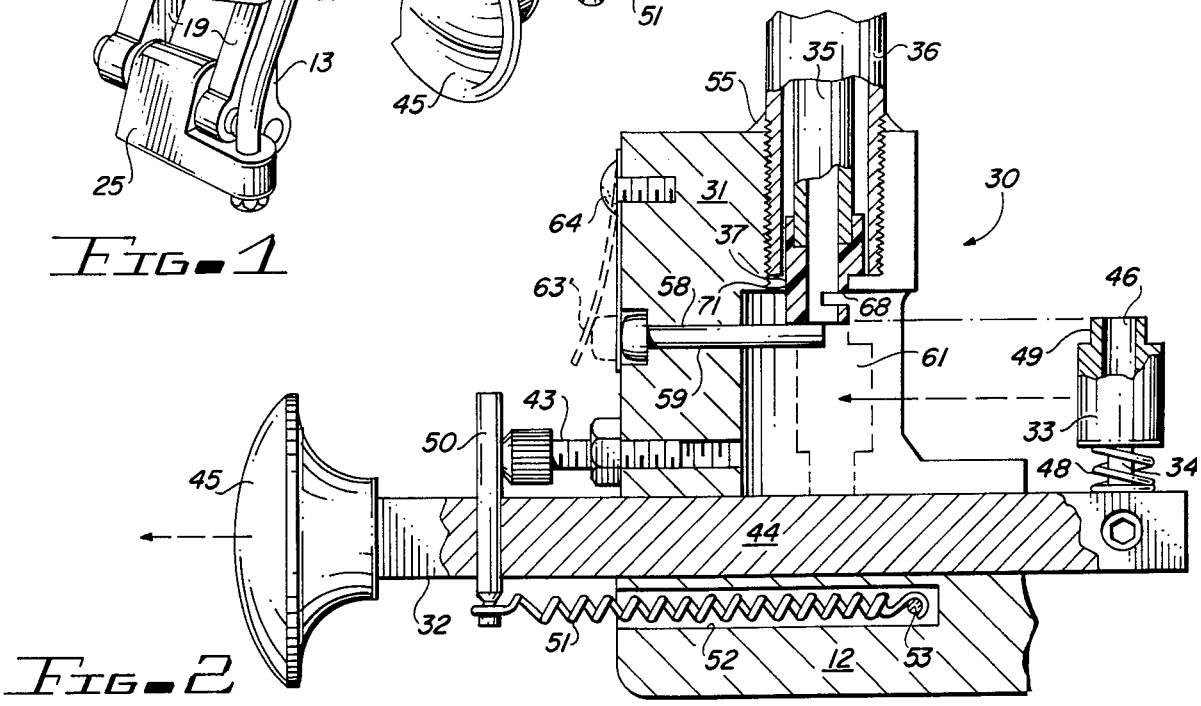
FIG. 2

SHELL RELOADING MACHINE WITH SAFETY FEATURES

BACKGROUND OF THE INVENTION

For those who regularly fire rifles or pistols, the cost of ammunition is an expensive consideration. The professional law enforcement agent or avid sportsman may fire a hundred rounds or more of ammunition in a single practice session with the expended raw materials used in addition to its monetary costs inevitably pointing to the need for an appropriate salvage operation to recover and re-use the spent shells.

DESCRIPTION OF THE PRIOR ART

Shell reloading machines have been known for many years. U.S. Pat. No. 2,031,850 describes a progressive reloading machine which simultaneously performs the several functions required in the reloading process. The exploded primer cap is removed, a new primer is inserted, powder is delivered, the end of the shell is enlarged to receive the bullet and a bullet is positioned with each operation of the machine. These several operations take place on a series of shells carried by the machine on a carriage which is manually rotated so as to move each of the several shells carried thereby simultaneously from one station to the next until the complete set of operations have been performed on each shell. A lever is operated to execute the various operations simultaneously on the several shells, so that while one shell is having its exploded primer cap removed, another shell is having a new primer inserted therein, etc. Once an individual shell has completed the sequential steps of the apparatus, it is removed from the carriage and is replaced by another spent shell.

An improved shell reloading machine is described in U.S. Pat. No. 4,163,410 which utilizes a swinging toggle linkage positioned below the tool head and shell carriage and incorporates a swaging operation for the preparation of the primer cavity. An indexing mechanism automatically advances the shell plate after each operation.

U.S. Pat. No. 4,343,222 describes another improved shell reloading machine that retains much of the utility and convenience of the prior art machines, but employs a construction that permits a significantly lower manufacturing cost.

One problem that has not been adequately addressed in these prior art machines involves the handling of the primer caps. The hazard of a primer cap explosion exists when a primer becomes jammed in the primer feed mechanism.

The present invention incorporates safety features in the primer feed mechanism which substantially reduce this hazard.

SUMMARY OF THE INVENTION

In accordance with the invention claimed, an improved shell reloading machine is provided which incorporates an effective and safe primer feed mechanism.

It is, therefore, one object of this invention to provide an improved machine for reloading shells.

Another object of this invention is to provide a machine which is capable of executing all of the essential operations involved in reloading including those performed by prior art machines such as removal of the exploded primer cap, swaging the primer cap opening, resizing of the shell casing, insertion of a replacement primer, measurement and delivery of the powder charge, expanding and reshaping of the open end to receive the bullet, and positioning of the bullet all in a safe and efficient manner.

A further object of this invention is to provide a machine in which the several functions are executed progressively on a number of shells being processed simultaneously with each shell experiencing a different functional operation at each stroke of the machine.

A still further object of this invention is to provide such a progressive shell reloading machine in which only one operating stroke is required per reloaded shell.

A still further object of this invention is to provide in combination with such a multi-shell moving platform a swinging toggle drive linkage which offers sufficient mechanical advantage to permit the incorporation of such operations as swaging which are especially demanding in terms of driving force.

A still further object of this invention is to provide in such a progressive shell reloading machine a primer feed mechanism that is both effective and free of the hazard of primer explosions which have, in some prior art machines, resulted from the jamming of the primer and the feed mechanism.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which:

FIG. 1 is a perspective view of an improved shell reloading machine embodying the invention;

FIG. 2 is a partial cross-sectional view of FIG. 1 showing the primer feed mechanism as viewed along the line 2—2;

FIG. 3 is an enlarged perspective view of the primer feed mechanism shown in FIGS. 1 and 2;

FIG. 4 is an enlarged perspective view of the lower portion of the primer magazine;

DESCRIPTION OF THE PREFERRED EMBODIMENT

Figures 5, 6, 7, 8, 9, 10, 11:
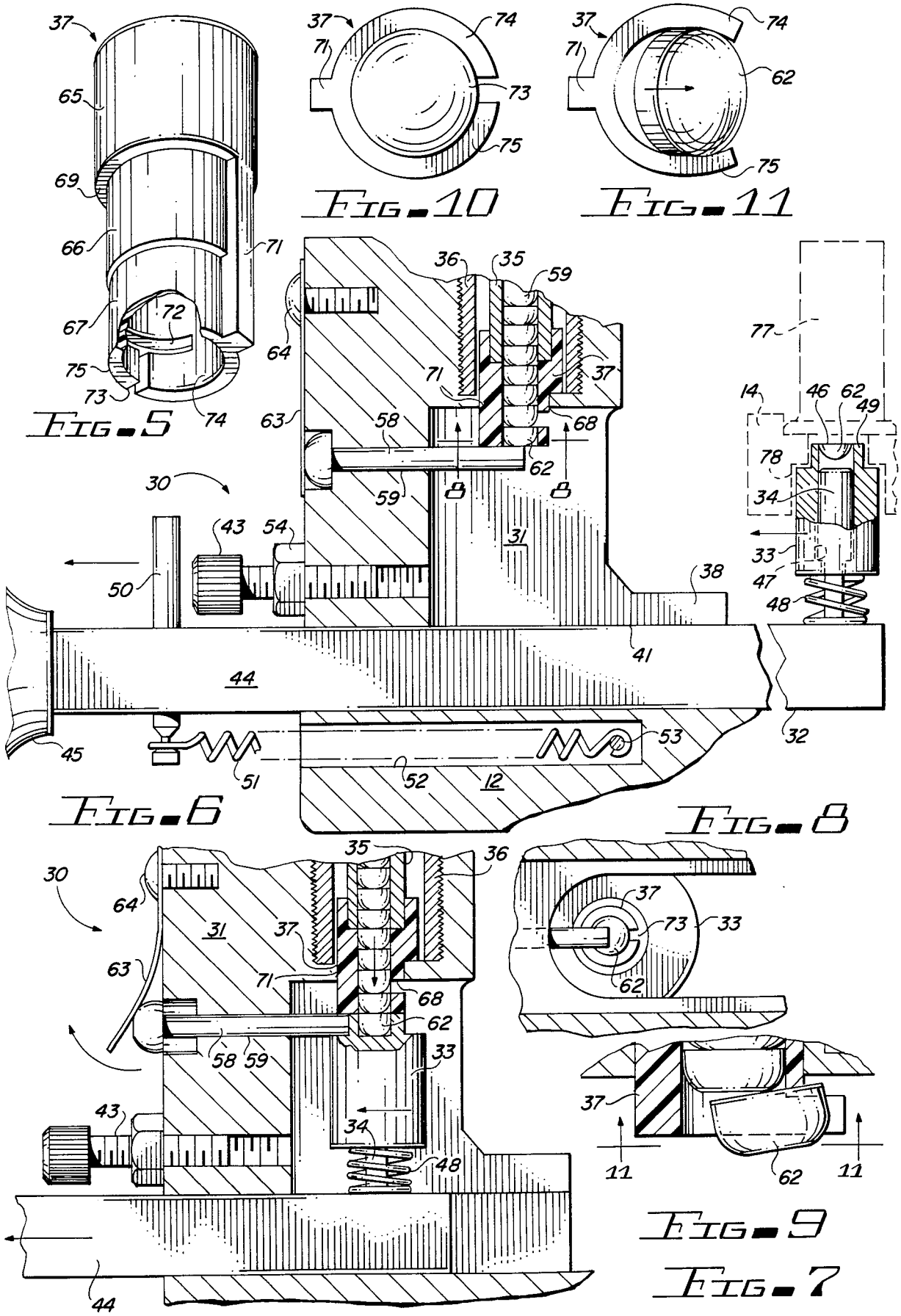
FIG. 5 is another view of the lower portion of the primer magazine with a part of its structure cut away to reveal details of its construction.
FIG. 6 is another cross-sectional view showing the primer feed mechanism in a different operating position.
FIG. 7 is yet another cross-sectional view of the primer feed mechanism in a still different operating position.
FIG. 8 is a partial view of the primer feed mechanism as seen along line 8—8 of FIG. 6.
FIG. 9 is a side view of the lower end of the primer magazine illustrating the operation of the safety feature incorporated to prevent jamming and detonation of the primer.
FIG. 10 is a bottom view of the primer magazine with the primer in its normal position.
FIG. 11 is a bottom view of the primer magazine showing a malpositioned primer being safely ejected, the view being taken along line 11—11 of FIG. 9.

Referring more particularly to the drawings by characters of reference, FIGS. 1–11 disclose an improved shell reloading machine 10 comprising a frame 11 and base 12, a piston or drive shaft 13, a moving shell platform 14, a four-position shell plate 15, a stationary tool platform 16, a powder loading magazine 17, two swinging toggle linkage arms 19 and an operating lever 21.

The frame 11, as shown in FIG. 1, is in the form of an inverted U, its lower ends being welded to or integral with the rectangular base 12. Base 12 is formed to permit it to be secured to a table or bench with frame 11 and base 12 being cast from aluminum, steel or other high-strength material to form a sturdy construction.

A drive cylinder, hidden from view in the drawing, is secured to base 12. The drive cylinder holds shaft 13 in an upright position.

Shaft 13 fits closely within the drive cylinder, but is free to be moved vertically therein. The fit is relatively precise to insure a stable alignment for shaft 13 with other parts of machine 10.

The shell platform 14 is in the form of a circular wafer and is rigidly secured to or integral with the top end of shaft 13.

Shell plate 15 is in the form of a flat disc having four slots 22 equally spaced and opening outwardly abouts its periphery. These slots are specially shaped and undercut to grip the flanged base of the shells which are to be reloaded. Plate 15 is positioned atop platform 14 and is held in a centered position thereon by a thumbscrew 23. Thumbscrew 23 holds plate 15 against the surface of platform 14 but is not so tightly secured as to prevent plate 15 from rotating abouts its center to locate each of the four slots at any of four discrete positions where they are held by an indexing means not shown in the drawing.

The various tools 24 employed in the progressive operations of the reloading process are secured to platform 16 by being turned into threaded holes spaced about a circle in four positions accurately aligned with the corresponding four positions of the indexed shell plate 15.

Operating lever 21 is coupled to drive shaft 13 by means of a swinging toggle arrangement comprising linkage arms 19, a pivot bar 25 secured to the lower end of lever 21 and additional members that are hidden from view in the drawing. The swinging toggle linkage is particularly advantageous for this application because the maximum mechanical advantage is obtained at the end of the stroke where maximum forces are applied in the various reloading operations. A detailed description of the swinging toggle linkage is given in prior art U.S. Pat. No. 4,343,222.

All but one of the reloading operations are performed at the uppermost position of the shell platform 14 as the shells carried by platform 14 are forced against the various tools 24 supported by stationary platform 16. The one exception is the seating of the new primer which is accomplished at the fully downward position of platform 14.

In the utilization of the machine 10, a spent shell is first loaded into the machine at a first position of shell plate 15 which will be referred to as position No. 1. The operating lever 21 is then lowered to raise platform 14. The shell installed in position No. 1 is driven upwardly into one of the tools 24 to perform a first machine operation which might comprise the sizing of the shell and removal of the spent cap. FIG. 1 shows a chute 26 positioned to guide the spent cap into a hopper 27. As lever 21 is then raised, a new primer cap is seated in a manner to be described later in this specification.

Upon completion of the primer operation shell plate 15 is advanced manually, carrying the first shell to a second shell position to be referenced position No. 2.

A second shell is then inserted at position No. 1 and lever 21 is operated a second time to perform the sizing and priming operations on the second shell while the first shell is loaded with powder at the second shell position.

The shell plate 15 is then manually advanced again to move the first shell to position No. 3 and the second shell to position No. 2.

A third shell is inserted at position No. 1 and lever 21 is operated again to size and prime the third shell while loading powder into the second shell at position No. 2 and at the time seating a bullet in the first shell at position No. 3.

Shell plate 15 is then again advanced manually to move the first shell to position No. 4, the second shell to position No. 3 and the third shell to position No. 2. A fourth shell is inserted at position No. 1 and lever 21 is operated again, this time sizing and priming at position No. 1, loading powder at position No. 2, seating a bullet at position No. 3 and crimping at position No. 4.

The plate is then advanced manually once more, moving the first shell once more to position No. 1. The reloaded shell is then removed from position No. 1 and is replaced by a fifth spent shell. After each succeeding operation of lever 21, a reloaded shell is removed from position No. 1 and is replaced by another spent shell.

The seating of the new primer cap which was passed over in the foregoing description of machine operation utilizes the primer feed and installation mechanism 30 shown most clearly in FIGS. 2, 3, 6 and 7.

The primer feed and installation mechanism 30 comprises a primer feed body 31, a primer slide 32, a primer seating cup 33 and ram 34, a primer magazine 35, a primer magazine shield 36 and a flexible orifice 37.

Primer feed body 31 as shown in FIG. 3 is fashioned from a metal casting having a horizontal base 38 and an upright member 39. Base 38 has a rectangular footprint, the longer dimensions of which are directed toward one of the positions of shell plate 15, specifically toward position No. 1, which was described earlier as the position at which the priming operations are executed. A rectangular channel 41 oriented in this same direction passes through the underside of base 38. The channel 41 is intended to carry the primer slide 32. Upright member 39 has a vertically oriented opening 42 through its forward end. The opening 42 receives the primer magazine 35, primer magazine shield 36 and flexible orifice 37. Also mounted in body 31 is a positioning screw 43. Primer feed body 31 is secured to base 12 of machine 10 in the indicated position and orientation by means of screws passing upwardly through base 12 into threaded holes in the underside of body 31. The mounting screws are not shown in the drawing.

Primer slide 32 comprises an elongated metal bar 44 with an actuator knob 45 at one end and with the primer seating cup 33 and ram 34 at the opposite end. The cross-section of bar 44 is rectangular, its dimensions corresponding closely with those of channel 41 but very slightly smaller so that bar 44 may be moved smoothly through channel 41. With body 31 secured to the top surface of base 12 as described earlier, and with bar 44 installed in channel 41, the underside of bar 44 rests upon and moves over the flat top surface of base 12, so that base 12 provides a stable platform for bar 44.

Ram 34 is rigidly secured to the forward end of bar 44 and extends perpendicularly upward from its top surface. The upper end of ram 34 has an enlarged diameter relative to its lower end.

Primer seating cup 33 has the general form of a cylindrical shell with a reduced inside diameter at its lower end. Its inside diameter at the upper end is dimensioned to receive the enlarged upper end of ram 34 and the reduced inside diameter at the lower end receives the lower end of ram 34. The shoulder 47 formed at the junction of the upper and lower inside diameters of cup 33 as shown in FIG. 6 retains cup 33 in an upwardly-biased position to which it is driven by a compression spring 48 that is installed over the lower portion of ram 34 between the juxtapositioned underside of cup 33 and upper surface of base 12. The upper end of cup 33 has a reduced outside diameter, the reduced outside diameter forming a thin wall 49 about the enlarged upper opening 46. As shown in FIG. 6, in the upwardly-biased position of cup 33, the top surface of ram 34 forms with wall 49 at opening 46 a small cylindrical or cup-shaped cavity. This cavity is dimensioned so that a primer cap will fit into it relatively loosely.

About an inch forward of knob 45 a metal pin 50 extends vertically through bar 44 and is secured therein by a friction fit. From the lower end of pin 50, a coil spring 51 extends through a cavity 52 to a point of attachment 53 on base 12. The spring 51 is in tension and urges slide 32 forward. The upper end of pin 50 serves as a stop for the forward position of slide 32 at which pin 50 impinges upon the head of the adjustable positioning screw 43. Screw 43 is a cap screw with a knurled head. The forward position of slide 32 may thus be adjusted by rotating screw 43. A locking nut 54 is provided to secure the position of screw 43.

As shown most clearly in FIG. 3, the primer magazine 35 is a relatively thin-walled cylindrical tube that fits inside the primer magazine shield 36. Shield 36 is a heavier tube or pipe made of a high-strength material such as steel that resists explosive forces which might occur upon the accidental detonation of primer caps contained by the aluminum magazine 35. The orifice 37 attaches by compression fit over the lower end of magazine 35. Magazine 35, shield 36 and orifice 37 are mounted in opening 42 of primer feed body 31 as shown most clearly by FIGS. 2, 6 and 7. Shield 36 is first installed in opening 42. This is intended as a permanent installation. A threaded connection as shown is acceptable but a locking means such as a weld bead 55 should be employed to prevent removal of the shield. A press fit between shield 36 and opening 42 may also be employed. Magazine 35 with orifice 37 attached to its lower end is then inserted through the upper end of shield 36.

A cap 56 is attached to the upper end of shield 36 by means of a threaded connection. The underside of cap 56 has a centered annular depression which receives the upper end of magazine 35 whereby magazine 35 is centered inside shield 36. A centered hole 57 in cap 56 having a diameter equal to the inside diameter of magazine 35 permits the loading of primer caps into magazine 35 while cap 56 is in place. In the installed position of magazine 35 the lower end of orifice 37 is aligned with the top surface of cup 33 as shown in FIG. 2. Also aligned with the lower end of orifice 37, as shown in FIG. 6, is a primer cap retainer pin 58. Pin 58 passes through an opening 59 in body 31 of mechanism 30. The opening 59 passes horizontally from the rear surface of body 31 through upright member 39 into a cavity 61 at the lower end of opening 42. The opening 59 is countersunk at the surface of member 39 to receive the head of pin 58. When pin 58 is installed all the way into opening 59, the top of its head flush with the surface of member 39, its tip at the opposite end extends just past the vertical centerline of magazine 35, and its edge just clears the lower end of orifice 37 so that any primer caps 62 contained in magazine 35 are prevented from falling out the lower end of orifice 37 by the extended end of pin 58.

Pin 58 is held in the position just described by a flat spring 63 that is secured to the rear surface of member 39 by a screw 64. The lower end of spring 63 covers the countersunk opening 59 and the head of pin 58.

Orifice 37 is made of a flexible plastic material. As shown most clearly in FIGS. 4 and 5, it has the general shape of a cylindrical shell. Its outer surface is stepped in three segments 65, 66 and 67 of sequentially reduced diameters progressing from top to bottom. Its inside diameter is uniform except at the upper end where a segment of increased inside diameter is provided to fit over the outer surface of magazine 35. This permits a smooth, uniform transition from the inside surface of magazine 35 to the inside surface of orifice 37. The outer diameter of segment 66 is dimensioned to just clear the entry 68 into cavity 61 at the bottom of opening 42. The shoulder 69 formed at the junction of segments 65 and 66 limits the penetration of orifice 37 through entry 68 and thus accurately locates the vertical position of the lower end of orifice 37. A longitudinal ridge 71 fits into a mating groove in the rear of entry 68 to assure the proper rotational orientation of orifice 37. A horizontal or lateral slot 72 penetrates the upper end of segment 67. The slot 72 covers a 180 degree arc of segment 67 at its upper extremity just below the junction of segments 66 and 67 and directly opposite ridge 71. A vertical or longitudinal slot 73 in segment 67 is also provided at a position directly opposite ridge 71. Two flexible tabs 74 and 75 are thus provided at the two sides of slot 73, the two tabs facing forward in the installed position of orifice 37.

As shown in FIGS. 2, 6, 7 and 8, the proper orientation of orifice 37 as controlled by ridge 71 and the mating groove in member 39 is such that slot 73 faces forward in the direction of primer seating cup 33.

The primer cap seating operation proceeds as follows:

A replacement primer cap is first loaded into primer seating cup 33. As shown in FIG. 6, the primer caps 62 held by magazine 35 are prevented from dropping out of orifice 37 by the extended forward end of pin 58, the pin 58 being driven forward by spring 63. The operator of machine 10, gripping knob 45, moves primer slide 32 rearward until cup 33 has moved to the loading position shown in FIG. 7, where cup 33 is positioned directly below magazine 35 and orifice 37. As cup 33 is moved into this position, pin 58 is displaced by wall 49 of cup 33. In the fully rearward position of slide 32, the head of pin 58 drives spring 63 to its stressed position as shown in FIG. 7. The rearward motion of slide 32 is arrested at this point by virtue of physical contact between cup 33 and the wall of cavity 61. The displacement of pin 58 from its forward position now permits the passage of a primer cap 62 from orifice 37 into the cavity formed by wall 49 about the top surface of ram 34.

The operator now moves primer slide 32 forward. As cup 33 leaves its rearward position inside cavity 61, spring 63 drives pin 58 forward to the position in which it again restrains the passage of primer caps through orifice 37. The forward motion of slide 32 continues until cup 33 is aligned with the No. 1 position of shell platform 11 at which the primer sizing and cap installations are executed. This position of slide 32 is precisely controlled through an adjustment of positioning screw 43 which insures that the proper position is achieved when pin 50 has moved into physical contact with the head of screw 43 as shown in FIG. 2.

The operator now raises lever 21 causing the shell at the No. 1 position to be lowered toward cup 33. As shown in FIG. 6, the shell 77, which has been sized during a preceding downward stroke of lever 21, is brought down upon cup 33 and ram 34. Cup 33 enters a cavity 78 in the base of shell plate 14. As plate 14 and shell 77 move further downward, contact is made between the top surface of cup 33 and the juxtapositioned surfaces of cavity 78. The continuing downward motion of plate 14 drives cup 33 downward against the force of spring 48. As this occurs, ram 34 carries primer cap 62 upward and seats in the sized opening at the base of shell 77.

The installation of the cap 62 having now been completed, lever 21 is operated to raise plate 14. Slide 32 is then withdrawn in preparation for loading another cap into cup 33.

A key feature of the invention comes into play in the event of a malfunction involving the operation just described. A particular type of malfunction is of interest in which for some reason the primer cap 62 does not become properly positioned atop ram 34 before slide 32 is moved forward. Such improper positioning of the cap could result from the presence of metal shavings on ram 34 or it could result from an improper installation of ram 34 on bar 44. Whatever the cause of the improper positioning of the cap 62, the result can be a jammed cap. As shown in FIG. 9, the mispositioned cap 62 is driven against the forward wall of the orifice 37. The orifice 37 has been intentionally designed to yield under this circumstance to prevent detonation of the cap 62 as can occur when a rigid metallic orifice is employed as in the case of prior art machines. Because the orifice 37 is made of a flexible plastic material and because its flexibility is enhanced by virtue of the horizontal and vertical slots 72 and 73, respectively, the force of the mispositioned cap 62 drives the tabs 74 and 75 forward as shown in FIGS. 9 and 11. The tabs 74 and 75 then open and the cap 62 is ejected without danger of a detonation. A significant safety hazard has thus been eliminated.

This feature together with the permanent non-removable mounting of shield 36 result in a higher degree of safety for the machine 10 of this invention than has been afforded in prior art machines.

An improved shell reloading machine has thus been provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed:

1. A shell reloading machine comprisingiin combination:

a first frame, a revolubly mounted shell registering plate adapted to carry a plurality of shells, a support mounted on and arranged to extend above said first frame and said plate, a plurality of tools mounted on said support, one at each of a plurality of work stations for preparing and reloading shells depending from said plate and arranged in a circle so as to register with a plurality of shells held by said plate, said tools sequentially comprising one at each of said work stations a sizing die for reshaping the shells' outer wall and dislodging the spent primer from a primer cavity in the shell, primer cap insertion tool for inserting a new primer cap in the primer cavity of the shell, a powder dispenser and a bullet positioner and securing element, a first means for sequentially supplying primer caps to said primer cap insertion tool, said first means comprising a second frame mounted on said first frame, a magazine for containing a plurality of stacked primer caps mounted on said second frame and having an orifice means defining a discharge opening for sequentially dispensing said caps one at a time, said orifice means being formed of a flexible material with the discharge opening for caps being slotted for flexing purposes if required to avoid blockage, a cup for sequentially receiving said caps from said magazine one at a time, a second means comprising a spring biased bar having said cup mounted on one end thereof mounted on said second frame for repetitively moving said cup from said primer cap insertion tool to said orifice and back to said primer insertion tool, and a third means comprising a rod mounted on said second frame and biased for normally blocking said orifice means to prevent said caps from moving therethrough, said one end of said rod being engaged and movable to an orifice non-blocking position when said cup is moved by said second means to said orifice means for receiving a cap, said third means being operable upon operation of said first means to cause one of said caps to move through said orifice and into said cup upon each operation of said first means, a drive cylinder comprising piston means mounted below said plate, said piston means being connected to said plate for moving shells mounted thereon into engagement with said tools, said plate being revolubly mounted on said piston means, and a lever arm pivotally mounted on said frame and connected at one end to said piston means for moving said plate toward and away from said tools to simultaneously execute various operations on the shells, said lever arm comprising an operating arm and a linkage.

said linkage being pivotally connected at one end to said frame and at the other end to said operating arm, whereby pivotal movement of said operating arm causes relative movement of said piston means.

2. The shell reloading machine set forth in claim 1 wherein:

said magazine comprises an elongated configuration having a protective shield mounted therearound.

3. The shell reloading machine set forth in claim 1 wherein:

said orifice is formed of a flexible plastic material.

4. A device for supplying primer caps to a primer cap insertion tool of a shell machine comprising:

a frame;

a magazine comprising an elonagated configuration for containing a plurality of stacked primer caps mounted on said frame and having an orifice means defining a discharge opening for sequentially dispensing said caps one at a time, said discharge opening being slotted for flexing pruposes to avoid blockage by the caps moving therethrough, a cup for sequentially receiving said caps one at a time, a first means comprising a spring biased bar mounted on said frame and having said cup mounted on one end thereof for repetitively moving said cup from an associated primer cap insertion tool to said orifice means, and a second means for normally blocking said orifice means to prevent said caps from moving therethrough, said second means being operable upon operation of said first means to cause one of said caps to move through said orifice upon each operation of said first means.

5. The device set forth in claim 4 in further combination with:

a protective shield mounted around said magazine.

6. The device set forth in claim 4 wherein:

said second means comprises a rod mounted on said frame and biased for normally causing one end of said rod to block said orifice means, said one end of said rod being engaged and moveable to an orifice non-blocking position when said cup is moved by said second means to said orifice means for receiving a cap.

7. The device set forth in claim 4 wherein:

said orifice means comprises a cylindrical shell having a first slot formed therein extending at one from said discharge opening longitudinally of said shell a predetermined distance.

8. The device set forth in claim 4 wherein:

said first slot is formed in said orifice means at a point facing said primer cap insertion tool.

9. The device set forth in claim 7 in further combination with:

a second slot extending circumferentially around a part of said shell and interconnecting with the other end of said first slot.

* * * * *

UNITED STATES PATENT OFFICE

CERTIFICATE OF CORRECTION

Patent No. 4,620,472 Dated November 4, 1986

Inventor(s) Stephen M. Dillon

It is certified that error appears in the above-identified patent and that said Letters Patent are hereby corrected as shown below:

Claim 1, line 1, cancel "comprisingiin" and substitute ---comprising in---.

line 49, after "orifice" insert ---means---.

Claim 4, line 2, after "shell" insert ---reloading---.

line 9, cancel "pru-" and substitute ---pur----.

Claim 7, line 3, after "one" insert ---end---.

Signed and Sealed this

Twentieth Day of January, 1987

*Attest:*

DONALD J. QUIGG

*Attesting Officer*

*Commissioner of Patents and Trademarks*